US007822491B2

(12) United States Patent
Howlett et al.

(10) Patent No.: US 7,822,491 B2
(45) Date of Patent: Oct. 26, 2010

(54) SYSTEM FOR IMPROVING TIMEKEEPING AND SAVING ENERGY ON LONG-HAUL TRAINS

(75) Inventors: Philip George Howlett, Fairview Park (AU); Peter John Pudney, Yatala Vale (AU)

(73) Assignee: Ausrail Technologies Pty Limited, Sydney (AU)

( * ) Notice: Subject to any disclaimer, the term of this patent is extended or adjusted under 35 U.S.C. 154(b) by 392 days.

(21) Appl. No.: 10/515,946

(22) PCT Filed: May 20, 2003

(86) PCT No.: PCT/AU03/00604

§ 371 (c)(1),
(2), (4) Date: Feb. 23, 2006

(87) PCT Pub. No.: WO03/097424

PCT Pub. Date: Nov. 27, 2003

(65) Prior Publication Data

US 2006/0200437 A1 Sep. 7, 2006

(30) Foreign Application Priority Data

May 20, 2002 (AU) ..... PS 2411

(51) Int. Cl.
*G05B 13/02* (2006.01)
*G05B 19/18* (2006.01)

(52) U.S. Cl. ..... 700/28; 701/93; 246/21; 246/22; 246/27

(58) Field of Classification Search ..... 700/28; 701/93; 264/21–22, 27, 167 R, 182 R
See application file for complete search history.

(56) References Cited

U.S. PATENT DOCUMENTS 4,042,810 A * 8/1977 Mosher ..... 701/19

(Continued)

FOREIGN PATENT DOCUMENTS

CA 1065039 10/1979

(Continued)

OTHER PUBLICATIONS

"An algorithm for the optimal control of the driving of trains," by R. Franke et al.; Proceedings of the 39$^{th}$ IEEE Conference on Decision and Control, 2000 in Sydney. NWS. Australia. Dec. 12, 2000-Dec. 15, 2000.

(Continued)

*Primary Examiner*—Michael D Masinick
(74) *Attorney, Agent, or Firm*—Bose McKinney & Evans LLP

(57) ABSTRACT

A method and system for the operation of trains on a rail network, and particularly in the context of long-haul rail networks. The invention provides a method and system which monitors the progress of a train on a long-haul network, calculates efficient control profiles for the train, and displays driving advice to the train crew. The system calculates and provides driving advice that assists to keep the train on time and reduce the energy used by the train by: (i) monitoring the progress of a journey to determine the current location and speed of the train; (ii) estimating some parameters of a train performance model; (iii) calculating or selecting an energy-efficient driving strategy that will get the train to the next key location as close as possible to the desired time; and (iv) generating and providing driving advice for the driver.

38 Claims, 5 Drawing Sheets

U.S. PATENT DOCUMENTS

| | | | | |
|---|---|---|---|---|
| 5,457,634 | A * | 10/1995 | Chakravarty | 701/3 |
| 6,144,901 | A * | 11/2000 | Nickles et al. | 701/19 |
| 6,243,694 | B1 | 6/2001 | Bonisone et al. | |
| 7,197,485 | B2 * | 3/2007 | Fuller | 706/14 |
| 2005/0107895 | A1 * | 5/2005 | Pistikopoulos et al. | 700/52 |
| 2006/0058985 | A1 * | 3/2006 | Arslan et al. | 703/2 |

FOREIGN PATENT DOCUMENTS

| | | |
|---|---|---|
| EP | 554 983 | 5/1995 |
| EP | 755 840 | 1/1997 |
| EP | 467 377 | 6/1997 |
| WO | WO 99/14093 | 3/1999 |

OTHER PUBLICATIONS

"Algorithms on optimal driving strategies for train control problem," by J.X. Cheng et al.; Proceedings of the 3rd A World Congress on Intelligent Control and Automation, 2000 in Hefei, China, Jun. 28, 2000-Jul. 2, 2000.

* cited by examiner

SYSTEM FOR IMPROVING TIMEKEEPING AND SAVING ENERGY ON LONG-HAUL TRAINS

FIELD OF THE INVENTION

This invention relates to a method and system for the operation of trains on a rail network, and has particular application in the context of long-haul rail networks.

BACKGROUND OF THE INVENTION

The energy costs for railways are significant. By driving efficiently, these costs can be significantly reduced.

There are five main principles of efficient driving:

1. Aim to arrive on time. If you arrive early you have already wasted energy; if you arrive late you will waste energy making up the lost time.

2. Calculate your required average speed. On long journeys, simply dividing the distance remaining by the time remaining will give you an approximate holding speed. Recalculate during the journey to make sure you are still on target.

3. Aim to drive at a constant speed. Speed fluctuations waste energy. The most efficient way to drive is to aim for a constant speed.

4. Avoid braking at high speeds. Braking at high speeds is inefficient. Instead, coast to reduce your speed before declines and speed limits.

5. Anticipate hills. If the train is going to slow down on a steep incline, increase your speed before the incline so that the average speed on the incline does not drop too far below the hold speed. For steep declines, coast before the decline so that the average speed does not rise too far above the hold speed. Avoid braking.

A train journey can be divided into segments between "targets", that is, locations on the route where the time and speed are specified. There are many driving strategies that may be used to operate a train between one target and the next. One strategy is a "speed-holding" strategy, where a constant speed is maintained, except where prevented by speed limits and steep gradients. In practice, of course, speed limits and steep gradients can disrupt a significant part of a journey. If an efficient journey for a given holding speed V can be determined then V can be adjusted to find the efficient journey that satisfies the journey time constraint; if the time taken is too long then V is too low. In determining an appropriate holding speed it is possible to generate points on a cost-time curve for the journey.

Using this methodology a journey with holding speed V can be constructed as follows:

1. Ignoring speed limits and the initial and final speeds, construct a speed-holding journey with holding speed V. The speed of the train will vary with steep gradients.
2. Adjust the speed-holding journey to satisfy the speed limits.
3. Construct initial and final phases to satisfy the initial and final speed constraints.

However, using this methodology may not result in the most energy-efficient journey.

It is therefore an object of the present invention to provide a method and system for operating trains which overcomes or ameliorates at least one of the disadvantages of the prior art, or at least provides a useful alternative.

SUMMARY OF THE INVENTION

To this end, the present invention provides a method and system for determining driving advice for the operation of a train to assist in reducing the total energy used by the train.

More particularly, the invention provides a method and system for monitoring the progress of a train on a long-haul network, calculating efficient control profiles for the train, and displaying driving advice to a train operator.

Preferably the system calculates and provides driving advice that assists to keep the train on time and reduce the energy used by the train by:

(i) monitoring the progress of a journey to determine the current location and speed of the train;
(ii) estimating some parameters of a train performance model;
(iii) calculating or selecting an energy-efficient driving strategy that will get the train to the next key location as close as possible to the desired time; and
(iv) generating and providing driving advice for the driver.

Preferably tasks (i) to (iv) are performed continually so that the driving advice automatically adjusts to compensate for any operational disturbances encountered by the train.

The system of the present invention provides advice to drivers of long-haul trains to help them maintain correct schedules and minimise fuel consumption. The system comprises software for preparing journey data and an on-board computer for generating and displaying driving advice.

The present invention has particular application for long-haul freight rail networks.

BRIEF DESCRIPTION OF THE DRAWINGS

The invention will now be described in further detail, by way of example only, with reference to the accompanying drawings in which.

DESCRIPTION OF PREFERRED EMBODIMENT

Figure 1:
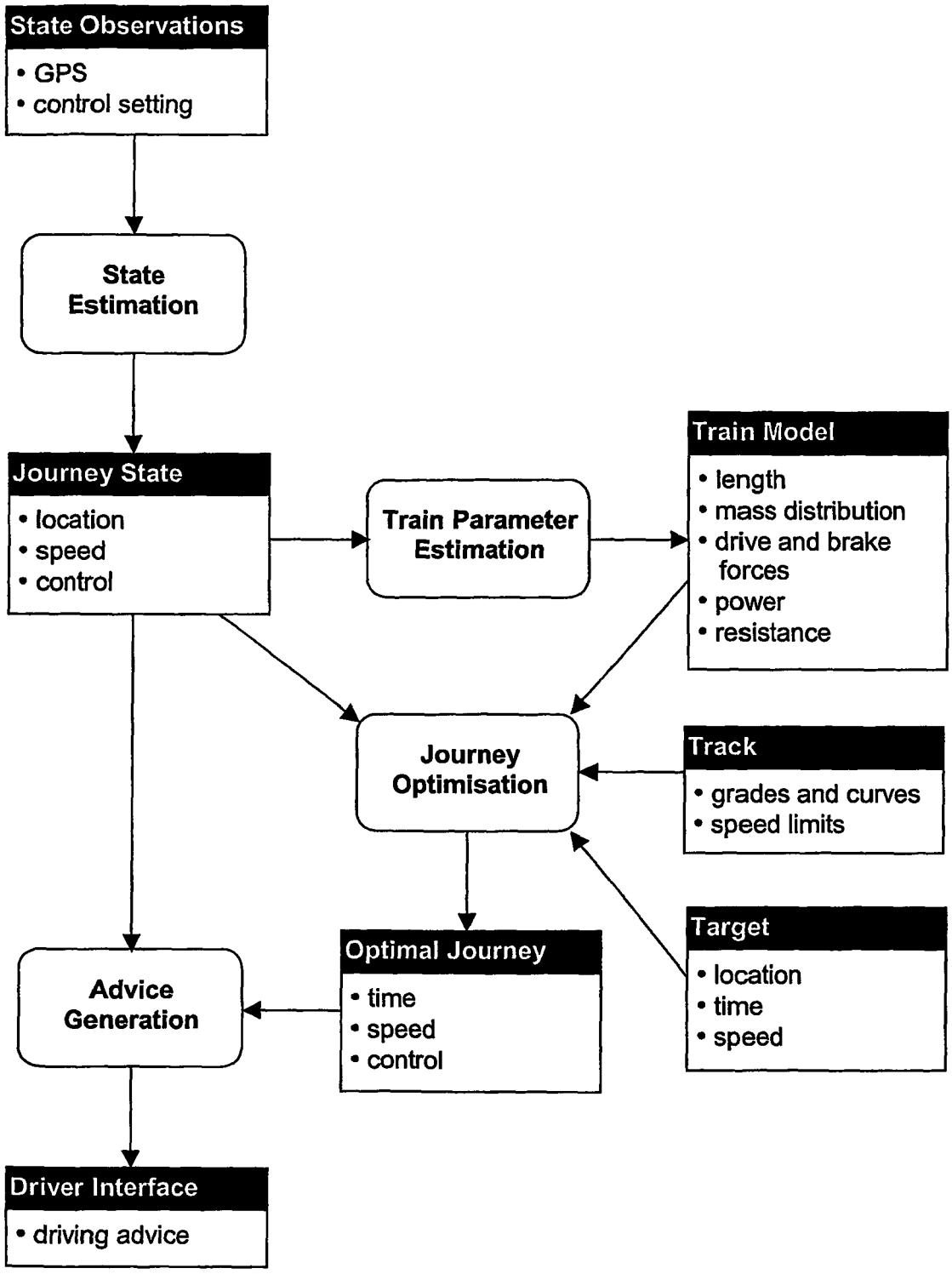
FIG. 1 shows a block diagram of the system according to a preferred embodiment of the present invention, illustrating the main data flows between various elements of the system.

The present invention, in one preferred form, provides a fully automatic system that monitors the progress of a train on a long-haul network, calculates efficient control profiles for the train, and displays driving advice to the train crew. In a further preferred embodiment the system works in conjunction with a dynamic rescheduling tool that coordinates interactions between various trains operating on the network.

The system assists the crew of a long-haul train by calculating and providing driving advice that assists to keep the train on time and reduce the energy used by the train. The system performs four main tasks:

(i) state estimation: monitors the progress of a journey to determine the current location and speed of the train;
(ii) train parameter estimation: estimates some parameters of a train performance model;

(iii) journey optimisation: calculates or selects an energy-efficient driving strategy that will get the train to the next key location as close as possible to the desired time; and (iv) advice generation: generates and provides driving advice for the driver.

These tasks are performed continually so that the driving advice automatically adjusts to compensate for any operational disturbances encountered by the train.

The system includes:

data communications between on-board units and a central control system;

automatic estimation of train performance parameters;

automatic re-optimisation of optimal journey profiles;

interaction with a manual or automatic train rescheduling system;

ergonomic driver interfaces.

Each of these four aspects of the methodology and system will now be discussed in further detail:

State Estimation

The station estimation task processes observations from a GPS unit and the train controls to determine the location and speed of the train and the current control setting.

Location is the position of the train on a given route, and is used to look up track gradient, curvature and speed limits. The state estimation task uses absolute and relative position data to determine the location of the train.

Control setting is required for train parameter estimation, and for estimating the energy use of the train if direct measurement of energy use is not available.

Train Parameter Estimation

The train parameter estimation task estimates parameters of a train performance model from the sequence of observed journey states.

The train model used by the in-cab system has the following train parameters:

train mass and mass distribution;

maximum tractive effort and maximum braking effort as functions of speed; and coefficients of rolling resistance.

Any of these parameters that are not known with sufficient accuracy before the journey commences must be estimated during the journey. The unknown parameters can be estimated using a Kalman filter.

If mass is to be estimated, the mass distribution is assumed to be uniform. If tractive effort is to be estimated it is assumed to take the form $$F_D(v) = \begin{cases} \dfrac{P}{v_0} & v \le v_0 \\ \dfrac{P}{v} & v > v_0 \end{cases}$$

where P is the maximum power of the train and $v_0$ is the speed below which maximum tractive effort is assumed to be constant.

In the simplest implementation, all train model parameters are known in advance and parameter estimation is not required.

Journey Optimisation

The optimal journey profile between a given journey state and a target journey state is found by solving a set of differential equations for the motion of the train and an additional differential equation that determines the optimal control. The optimal journey profile specifies the time, speed and control at each location of the track between the current train location and the next target.

Journey profiles can be precomputed or else calculated during the journey. If precomputed, several different journeys corresponding to different journey times are used on the train and the journey optimisation task then simply selects the precomputed profile that has the arrival time at the target closest to the desired arrival time.

If we use distance traveled, x, as the independent variable then the journey trajectory is described by the state equations $$\frac{dt}{dx} = 1/v \tag{1}$$

$$\frac{dv}{dx} = \frac{u - R(v) + \overline{G}(x)}{mv} \tag{2}$$

$$\frac{dJ}{dx} = u_+ + \eta_R u - \tag{3}$$

where t is elapsed time, v is the speed of the train, J is energy use, u is the controlled driving or braking force, R(v) is the resistive force on the train at speed v and $\overline{G}(x)$ is force on the train due to track gradient and curvature at location x, and m is the mass of the train. We assume that R and the derivative R' are both increasing functions.

This model is based on simple physics. It does not model the complexities of traction motors, braking systems, in-train forces or wheel-rail interactions. Nor does it need to; in practice, the driving advice derived from this simple model is both realistic and effective.

The state equations describe the motion of a point mass. In practice the length of a long-haul train can be significant. However, a long train can be treated as a point mass by transforming the track force function. Suppose the train has length L and that the density of the train at distance l from the front of the train is p(l). If we define $$\overline{G}(x)=\int_{l=0}^{L} p(l)G(x-l)dl$$

where G is the real track force then the motion of a point mass train on a track with track force $\overline{G}$ is equivalent to the motion of the long train on the real track.

The force u is controlled by the driver, and satisfies the constraints $F_B(V) \leqq u \leqq F_D(v)$ where $F_D(v)>0$ is the maximum drive force that can be achieved at speed v and $F_B(v)>0$ is the maximum braking force that can be achieved at speed v.

For most train journeys the speed of the train is constrained by speed limits that depend on location, and so the optimal journey must satisfy the constraint $v \leqq V_L(x)$.

The optimal control is founded by forming the Hamiltonian function $$\begin{aligned} H = {} & \pi_1 \frac{1}{v} + \pi_2 \frac{u - R(v) + \overline{G}(x)}{mv} + \\ & \pi_3[u_+ + n_R u -] - \\ & \alpha_B[F_B(v) - u] - \alpha_D[u - F_D(v)] - \\ & \alpha_v[v - V_L(x)] \end{aligned}$$

where $\pi_i$ are multipliers associated with the state equations and $\alpha_i$ are Lagrange multipliers associated with the control and speed constraints. The complementary slackness conditions are $$\alpha_B[F_B(v)-u]=\alpha_D[u-F_D(v)]=\alpha_v[v-V_L(x)]=0$$

There are three adjoint equations. The first and third adjoint equations are $$\frac{d\pi_1}{dx} = 0 \text{ and } \frac{d\pi_3}{dx} = 0$$

If we let $\pi_3=-1$ and $$\mu = \frac{\pi_2}{mv}$$

then the second adjoint equation can be written as $$\frac{d\mu}{dx} = \begin{cases} \frac{1}{mv}\left[\frac{\pi_1}{v^2} + \mu R'(v) + \alpha_v + (1-\mu)F_D'(v)\right] & u = F_D(v) \\ \frac{1}{mv}\left[\frac{\pi_1}{v^2} + \mu R'(v) + \alpha_v\right] & F_B(v) < u < F_D(v) \\ \frac{1}{mv}\left[\frac{\pi_1}{v^2} + \mu R'(v) + \alpha_v + (\eta_R - \mu)F_B'(v)\right] & u = F_B(v) \end{cases} \quad (4)$$

This equation is found by substituting each of the three control conditions into the Hamiltonian and then differentiating. The Lagrange multiplier $\alpha_v$ is zero when the train is travelling at a speed less than the speed limit.

The optimal control maximises the Hamiltonian, and so the optimal control depends on the value of the adjoint variable $\mu$. An optimal strategy has five possible control modes:

drive $1<\mu \Rightarrow$ maximum drive force $u=F_D(v)$ hold $\mu=1 \Rightarrow$ speed hold with $0 \leqq u \leqq F_D(v)$ coast $\eta_R<\mu<1 \Rightarrow$ coast with $u=0$ regen $\mu=\eta_R \Rightarrow$ speed hold with $F_B(v)<u<0$ brake $\mu<\eta_R \Rightarrow$ brake with $u=F_B(v)$ The hold mode is singular. For this driving mode to be maintained on a non-trivial interval requires $d\mu/dx=0$. If we are not constrained by a speed limit then we have $$v^2R'(v)=-\pi_1$$

But $\pi_1$ is a constant and the graph $y=v^2R'(v)$ is strictly increasing, so there is a unique hold speed V satisfying this equation.

Maintaining a speed limit also requires $\mu=1$. When a speed limit is encountered the adjoint variable $\mu$ jumps to $\mu=1$ and at the same time the Lagrange multiplier $\alpha_v$ jumps from zero to a positive value.

On a track with sufficiently small gradients and no speed limits the optimal trajectory is mainly speed holding at speed V. On most tracks, however, the track gradients disrupt this simple strategy. Track intervals can be divided into four speed-dependent classes:

(i) steep incline: if the maximum drive force is not sufficient to maintain the desired speed;

(ii) not steep: if the desired speed can be maintained using a non-negative drive force;

(iii) steep decline: if braking is required to maintain the desired speed; and (iv) nasty decline: if even maximum brake force is insufficient to maintain the desired speed.

The optimal strategy anticipates steep gradients by speeding up before a steep incline and slowing down before a steep decline.

An optimal trajectory with a given hold speed V can be found by setting $$\pi_1=VR'(V)$$

and then solving the differential equations (1) and (2) while using (4) and the optimal control modes to determine the control. These differential equations are solved using a numerical method such as a Runge-Kutta method. In practice, however, the adjoint equation is unstable. To overcome this difficulty we instead search for a pair of adjacent adjoint trajectories that are lower and upper bounds for the true adjoint trajectory. The lower and upper bounds start close together, but the adjoint values eventually diverge. This does not matter while they are both indicating the same control mode, but as soon as one of the bounds indicates a control change we research at that location to find new adjacent bounds that extend the journey.

The optimal journey trajectory can be constructed in this way as a sequence of trajectory segments between speed-holding phases, where speed holding can occur at the hold speed V or at a speed limit.

There are two ways a non-holding optimal trajectory segment can start:

1. Drive or coast with $(x_0, v_0)$ known and $\mu_0$ unknown. This occurs at the beginning of the journey or at the end of a low speed limit. Calculating an initial upper bound for $\mu$ is not usually possible, so instead we search for the location of the next control change.
2. Drive or coast with $x_0$ unknown but bounded, $v_0$ known and $\mu_0=1$. This may occur if we are holding at the hold speed or at a speed limit. The lower bound for $x_0$ is the start of the hold phase. The upper bound for $x_0$ depends on whether we are holding at the hold speed V or at a speed limit. If we are holding at the hold speed V then the upper bound for $x_0$ is the next location where either the track becomes steep or else the speed limit drops below V. If we are holding at a speed limit $V_L$ then the upper bound for $x_0$ is the next location where either the track becomes steep uphill or else the speed limit drops. If a steep decline is encountered during a speed limit phase then the brakes must be partially applied to hold the train at the speed limit.

There are three ways a non-holding optimal trajectory segment can finish:

1. At the end of the journey, with the correct speed.
2. At the hold speed with $v=V$, $\mu=1$ and the gradient not steep. The next trajectory segment will have start type 1.
3. At a speed limit with $v=V_L$. The next trajectory segment will have start type 2 with control coast, or else start type 1 with control drive.

Using these conditions, it is possible to construct a complete journey profile to the next target. This journey profile will be optimal for the resulting arrival time at the target. If the resulting arrival time is beyond the desired arrival time then another journey profile, with a higher hold speed, is calculated; if the arrival time at the target is prior to the desired arrival time then another journey profile is calculated, this time with a lower hold speed. A numerical technique such as Brent's method can be used to find the hold speed that gives the desired arrival time.

Advice Generation

The advice generation task compares the current state of the train to the corresponding state on the optimal journey profile and then generates and displays advice for the train operator that will keep the train close to the optimal profile.

Brake advice is given if braking is required to avoid exceeding a speed limit or a speed on the journey profile that has braking as the optimal control.

Coast advice is given if:

the speed of the train is significantly higher than the speed indicated by the optimal journey profile, or the speed of the train is near or above the speed indicated by the optimal journey profile and the optimal control is coast.

Hold advice is given if the speed of the train is near or above a holding speed indicated by the optimal journey profile. The speed to be held will be either a speed limit or the journey holding speed.

Power advice is given if none of the other driving modes are appropriate.

These decisions can be made without considering time because the optimal speed profile is automatically adjusted by the journey optimisation task to keep the train on time.

For each type of trip, the optimisation software is used to calculate optimal speed profiles for six difference total journey times. Each profile is designed to minimise fuel consumption for the given journey time. As the time allowed for the journey decreases the minimum possible fuel consumption increases.

During the journey the system uses a GPS unit to determine the position of the train. Given the speed and position of the train and the time remaining until the train is due at the next key location, the system selects the most appropriate of the precomputed profiles. Advice is generated to keep the train as close as possible to the selected profile. The crew will enter necessary information such as the arrival time at the next key location. The advice given to the driver will be one of:

Drive: drive using maximum power, subject to safety and train handling constraints;

Hold: vary the power to hold the indicated speed; or

Coast: set the power to zero subject to safety and train handling constraints.

Note that the driver is responsible for braking.

The system is able to work with pre-computed profiles because, in practice, if the control is changed too early or too late, switching between the difference pre-computed profiles will automatically adjust future control changes to compensate.

Energy savings can be achievable simply by demonstrating efficient control techniques to the train operator. Effective techniques can either be demonstrated on-board or by using simulations. However, because of the relationship between fuel consumption and journey time some form of on-board advice system is required to achieve the best possible fuel consumption, and is the reason why coasting boards by the side of the track do not work.

For example, if a train is running slowly and behind schedule because of a head wind, and the driver coasts at the usual location, the train will end up even further behind schedule. Of course, drivers will take train performance into account, but it is difficult for them to keep track of time and predict the effect their control decisions will have on the final arrival time.

The system of the present invention obtains maximum fuel savings without increasing running times because the system is an adaptive system based on optimal control theory.

The system can adjust the driving strategy using the actual observed train performance. All systems that rely on pre-computed profiles must take into account the current state of the train with regard to location, time and speed. Any system of non-adaptive control will give unreliable advice when the train is not in the right place at the right time doing the right speed. Non-adaptive systems could possibly be used on Metropolitan railways with fixed timetables and identical trains or on tightly controlled networks with unit trains carrying consistent loads using dedicated track, but not on networks where the trains and timetables vary from day to day.

EXAMPLE

In the following discussion of an example of the invention, the following notation is used:

Train m train mass (kg)

$F_D(v)$ maximum drive force at speed v (N)

$F_B(v)$ minimum brake force at speed v (N)

R(v) resistance force at speed v (N)

$\eta_R$ regenerative brake efficiency

Route

The length and mass distribution of a train can be used with a simple averaging procedure to transform the track gradients and speed limits so that the motion of a point mass train on the transformed track corresponds to the motion of the real train on the real track.

G(x) effective force due to gradient at distance x (N)

h(x) effective elevation of the track at x (m)

$\bar{v}(x)$ effective speed limit at x (ms-1)

State Variables x distance along the route (m)

t(x) time taken to reach distance x (s)

v(x) speed at distance x (ms-1)

J(x) energy cost at distance x (J)

Control and Adjoint Variable u applied drive force $0 \leqq u \leqq F_D(v)$ or brake force $F_B(v) \leqq u < 0$ (N)

μ an adjoint variable that determines the optimal control switching points

Steep gradients and speed limits mean that travelling at a constant speed for the entire journey is usually not possible. To find the optimal control for real journeys we use Pontryagin's principle, a standard technique of optimal control theory. The method is described for trains with discrete control in the book by Howlett and Pudney (1995), and for continuous control by Howlett and Khmelnitsky.

The continuous control model is easier to work with, and the results from the two models are practically identical. The optimal control at any stage of the journey depends on the value of an adjoint variable μ, which evolves as the journey progresses. There are five control modes in an optimal journey:

drive $1<\mu \Rightarrow u=F_D(v)$ hold $\mu=1 \Rightarrow 0 \leqq u \leqq F_D(v)$ coast $\eta_R \leqq u \leqq \mu \Rightarrow u=0$ regen $\mu=\eta_R \Rightarrow F_B(v) \leqq u \leqq 0$ brake $\mu<\eta_R \Rightarrow u=F_B(v)$ By analysing the equations for μ we can show that the control mode with μ=1 corresponds to speed holding. We can also show that during any one optimal journey, speed holding must always occur at the same speed, V. W>V. The holding speed V and the regen speed W are related by the simple formula $$\eta_R W^2 R'(W)=V^2 R'(V).$$

If regeneration is perfectly efficient then the regen speed is the same as the hold speed, and the coast mode never occurs. If the train does not have regenerative braking then the regen mode does not occur.

Using the same type of analysis we can show that the control mode with $\mu=\eta_R$ requires the use of regenerative braking to maintain a constant speed For a given hold speed V we can divide the track into four classes:

steep inclines, where maximum drive force is not sufficient to hold speed V;

not steep, where a proportion of the maximum drive force is sufficient to hold speed V;

steep declines, where braking is required to hold speed V; and nasty declines, where full brakes are not enough to hold speed V.

Figure 2:
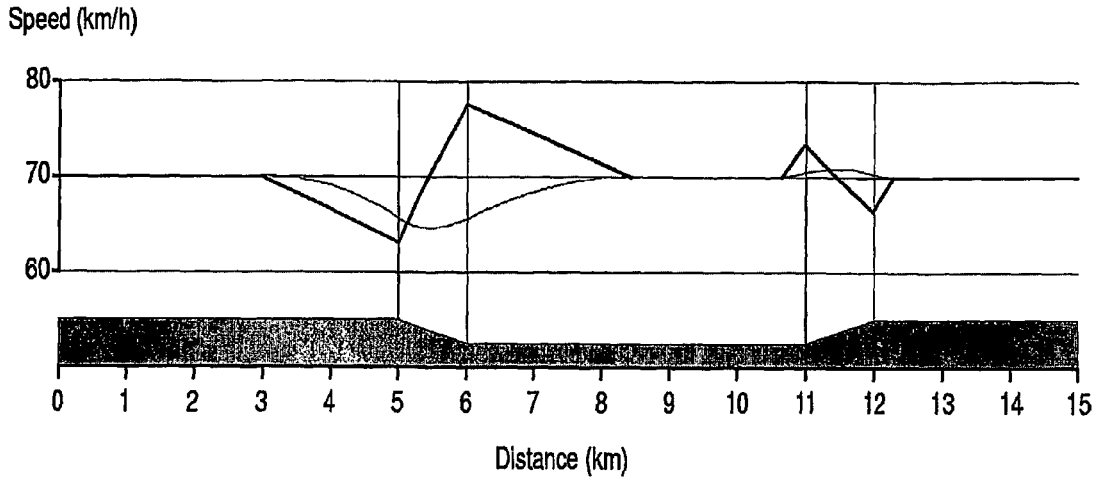
FIG. 2 illustrates an optimal speed profile for a train over a fictitious section of track.
Figure 3:
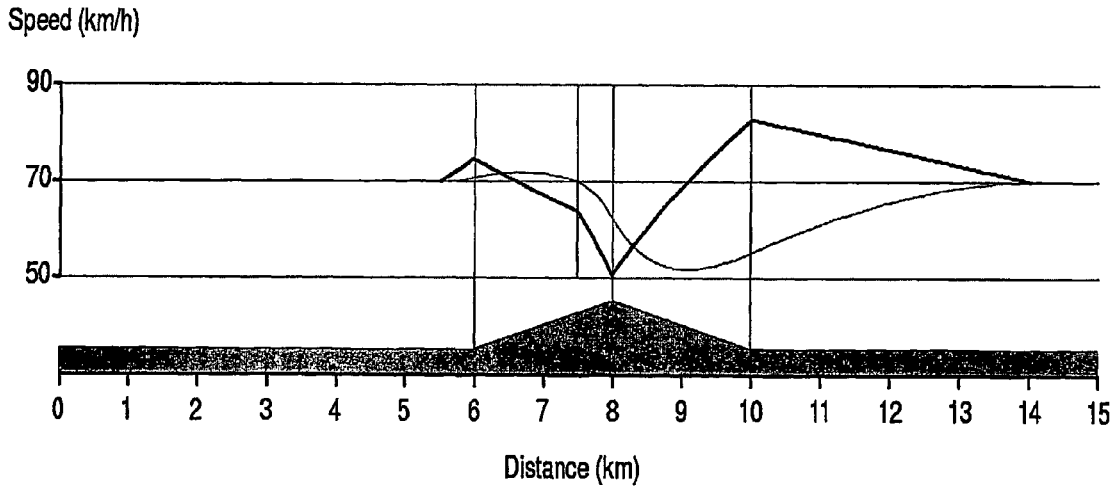
FIG. 3 illustrates an optimal speed profile for a train over another fictitious section of track.

We will assume that there are no nasty declines, nor any inclines so steep that the train can not get up them even at low speed. The key to handling steep grades is to anticipate the grade. For steep inclines, the speed of the train should be increased before the start of the incline; for seep declines, speed should be reduced before the start of the decline. FIG. 2 shows an optimal journey segment on a fictitious section of track. The holding speed is 70 km/h. The steep sections are each 1% grades. The optimal journey has the train coasting 2 km before the start of the decline, and driving 500 m before the start of the incline. The grey curve shows the adjoint variable used to determine the optimal control; it has been scaled and shifted to make it easier to see. For both the drive and the coast phases the adjoint variable starts and finishes at $\mu=1$.

Where steep grades are close together the correct switching sequence and switching points are more difficult to find, but they can be calculated using the adjoint equation. In FIG. 3 the steep sections are once again 1% grades. The control is switched from power to coast as the adjoint variable $\mu$ passes through $\mu=1$, before the top of the hill.

Figure 4:
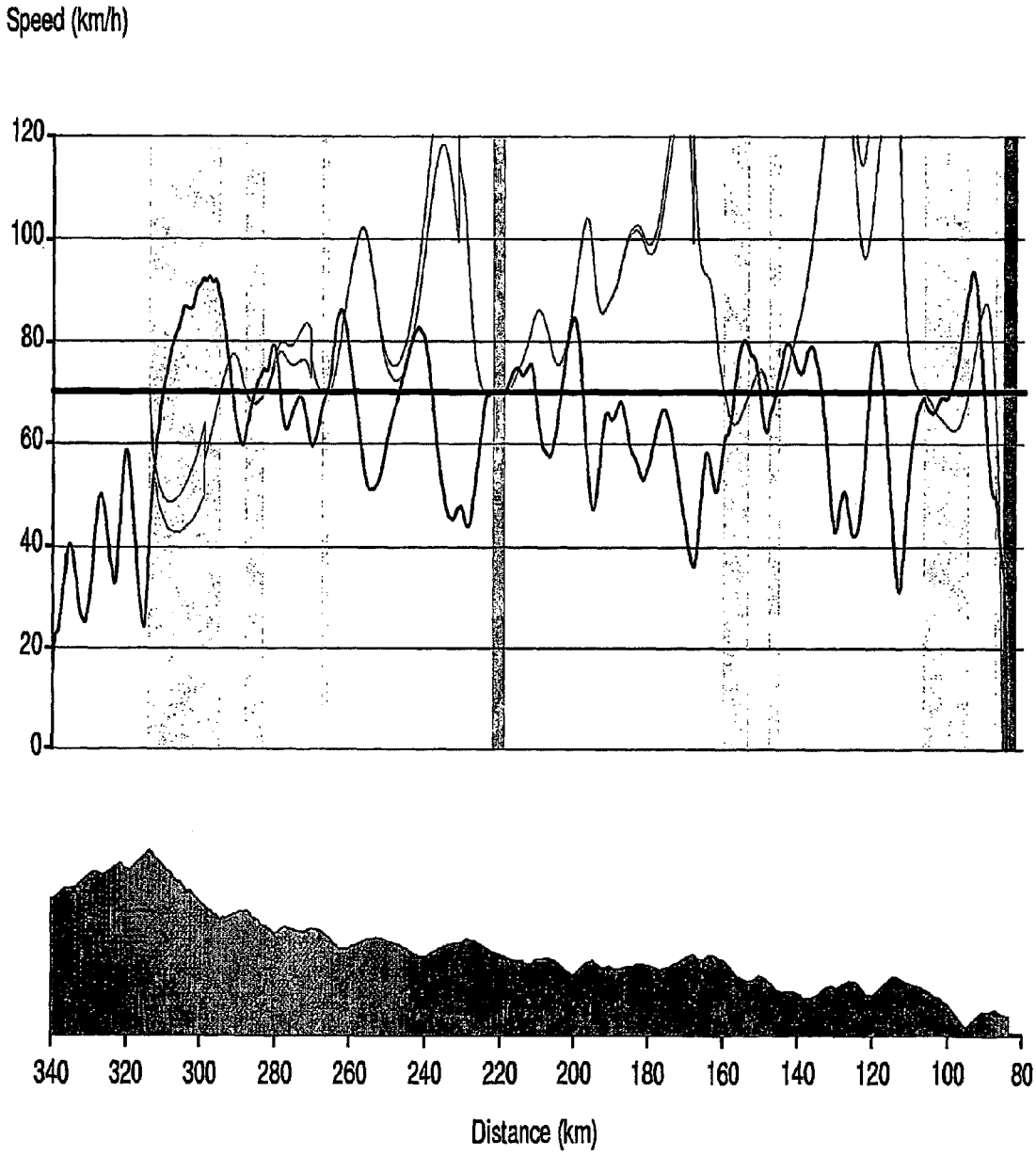
FIG. 4 illustrates an optimal journey for a coal train.

The same principle can be used to find an optimal speed profile for more complex journeys. FIG. 4 shows an optimal journey for a coal train. The hold speed is 70 km/h. The elevation profile has been smoothed to compensate for the length and mass distribution of the train.

This is a particularly difficult journey; there is only one short period of speed holding, indicated by the dark shading at 220 km. The lighter shading indicates periods of coasting. The dark shading at the end of the journey indicates braking.

On long journeys the adjoint variable can be difficult to calculate. The light curves show lower and upper bounds for the adjoint variable. We have to search for a more accurate value whenever the bounds become too far apart, or whenever one bound indicates a control change but the other does not.

The method used to calculate an optimal journey is easily extended to handle speed limits (Pudney & Howlett, 1994; Howlett & Pudney, 1995; Cheng et al, 1999; Khmelntisky). Whenever the speed profile meets a speed limit there is no choice but to apply partial braking to hold the speed of the train at the speed limit. At the point where the speed limit is encountered the value of the adjoint variable jumps by an amount that can be calculated. The optimal journey can be found as before, using the adjoint variable to determine the control and calculating the adjoint jump each time a speed limit is encountered.

To find the optimal strategy for a given journey time we need to find the appropriate hold speed. Simply dividing the journey time by the journey distance gives an initial guess. In most cases this guess will be an underestimate of the holding speed required; speed limits, gradients and the initial and final phases of a journey tend to reduce the actual average speed.

The time taken for an optimal journey with hold speed V decreases as V increases. We simply use a numerical search technique to find the hold speed that gives the correct journey time. As a by-product we generate a sequence of points (T, J) that describe the energy cost J of an optimal journey that takes time T. These points describe a cost-time curve that can be used for calculating timetables that take into account energy costs.

It may appear that the speed-holding strategy for long-haul trains is different to the drive-coast-brake strategy for suburban trains, but this is not so. On suburban journeys, the hold speed required to achieve the timetable on short journey sections is usually greater than the maximum speed that can be achieved before coasting and braking are required. The suburban drive-coast-brake strategy is simply a subset of the speed holding strategy used on longer journeys.

The invention is designed to work on a train with optimisation working as a background task continually updating the optimal speed profile from the current state of the journey to the next target.

Advice is provided from the result of comparing the current state to the optimal journey and generating appropriate control advice.

Figure 5:
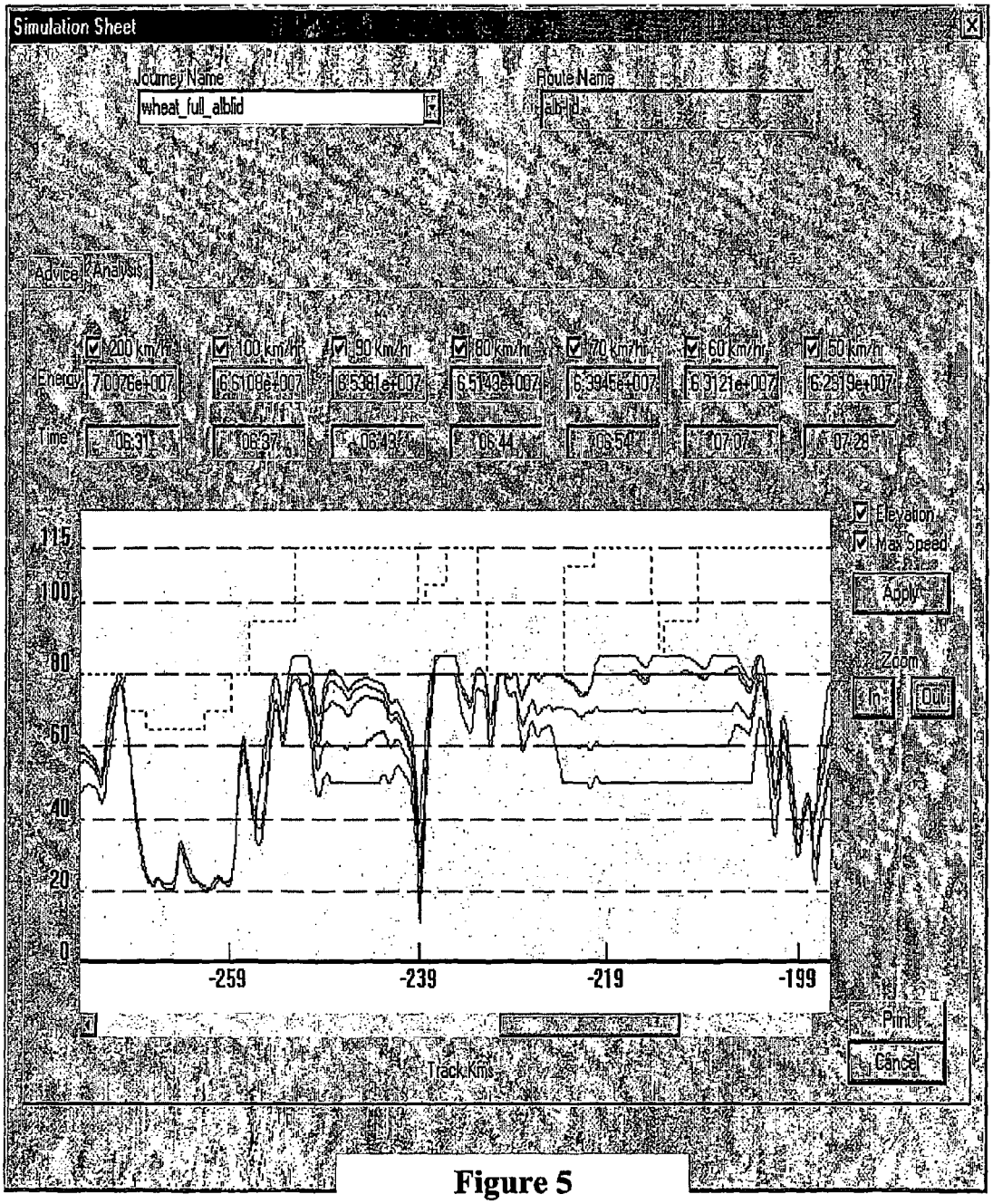
FIG. 5 shows the processing of precomputed speed profiles.
Figure 6:
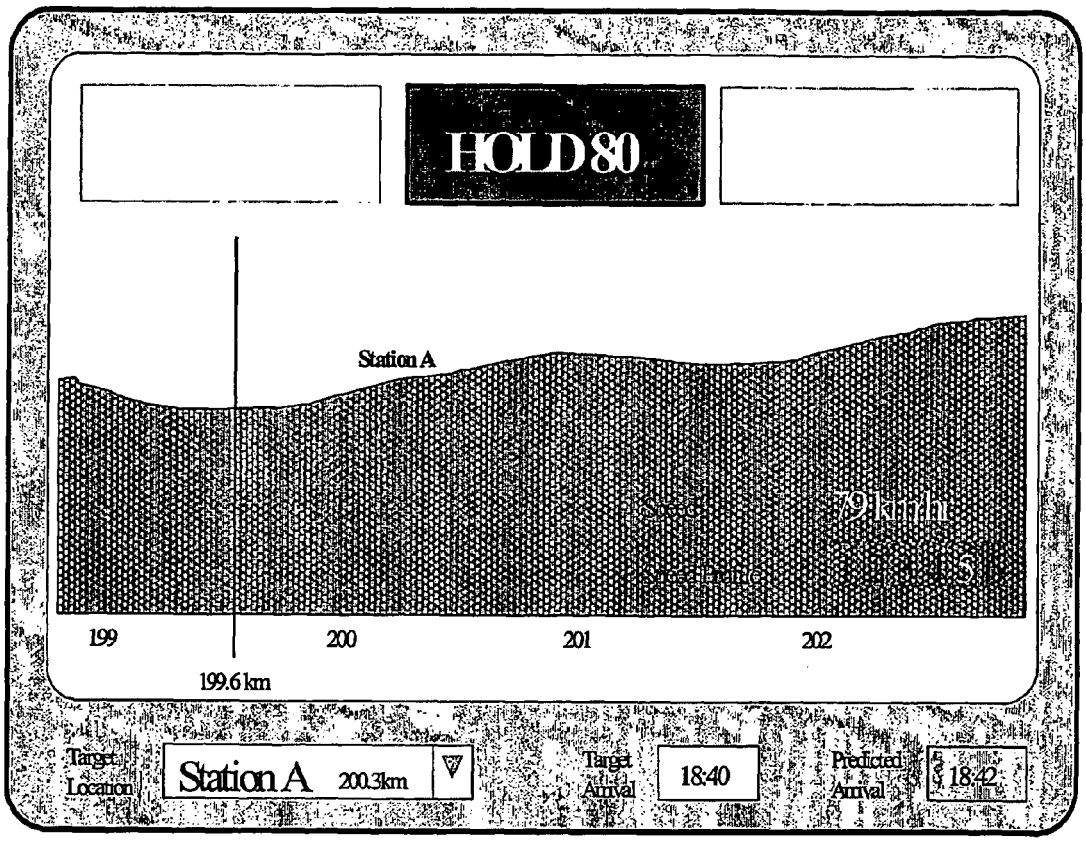
FIG. 6 illustrates the system display which provides the train operator with driving advice.

FIG. 5 shows the processing of precomputed speed profiles, and FIG. 6 shows a typical advice task.

Advantageously, the present invention at least in the preferred form provides one or more of the following benefits:

efficient driving strategies which can reduce energy costs by the order of 14% and improve time keeping and network performance.

improved on-time running, shorter waits at crossing loops;

reduced air braking, lower brake wear, reduced wear on traction motors, extended service life, lower maintenance costs;

improved consistency between drivers;

accelerated driver training.

Although the invention has been described with reference to specific examples, it will be appreciated by those skilled in the art that the invention may be embodied in many other forms.

The invention claimed is:

1. A method of monitoring the progress of a train on a rail network and providing driving advice in real time to an operator of the train, said method comprising:

(i) estimating or determining parameters of the train;

(ii) determining, by an optimal control algorithm employing an adjoint variable, an optimal journey profile for a journey from the train's current location to a target location that results in the train arriving at the target location as close as possible to a desired time and with minimum energy usage; said optimal journey profile including a speed profile for the train, sequence of discrete control modes for the train, and associated switching points between the control modes; the optimal journey profile being determined by solving a system of differential equations for the speed profile of the train and for the value of the adjoint variable and wherein the sequence of discrete control modes is a function of the value of the adjoint variable and is determined as the speed profile is calculated, and wherein drive, hold, coast and brake control modes are each utilizable as one of the control modes in said sequence of discrete control modes;

(iii) monitoring the current state of the train as it progresses to said target location; and (iv) generating said driving advice for the train operator by comparing the current state of the train to a corresponding state on said optimal journey profile and displaying said advice for the train operator that will keep the train close to said optimal journey profile.

2. The method of monitoring the progress of a train on a rail network as claimed in claim 1, wherein steps (i) to (iv) are performed as required so that said driving advice automatically adjusts to compensate for any operational disturbances encountered by the train.

3. The method of monitoring the progress of a train on a rail network as claimed in claim 1, wherein said parameters include train mass and mass distribution.

4. The method of monitoring the progress of a train on a rail network as claimed in claim 3, wherein said parameters further include maximum tractive efforts and maximum braking effort as functions of speed.

5. The method of monitoring the progress of a train on a rail network as claimed in claim 3, wherein said parameters further include coefficient(s) of rolling resistance.

6. The method of monitoring the progress of a train on a rail network as claimed in claim 1, wherein said driving advice is generated and displayed by a computer located on the train.

7. The method of monitoring the progress of a train on a rail network as claimed in claim 1, wherein step (iii) involves processing data from a GPS unit and train controls to determine the location and speed of the train.

8. The method of monitoring the progress of a train on a rail network as claimed in claim 1, wherein said optimal journey profile specifies the time, speed and control at each location between the current train location and the next target location on the network.

9. The method of monitoring the progress of a train on a rail network as claimed in claim 1, wherein said optimal journey profile is precomputed.

10. The method of monitoring the progress of a train on a rail network as claimed in claim 1, wherein the discrete control modes for the train include drive, hold, coast and brake modes.

11. The method of monitoring the progress of a train on a rail network as claimed in claim 1, wherein the adjoint variable evolves according to a differential equation along with the position and speed of the train.

12. The method of monitoring the progress of a train on a rail network as claimed in claim 1, wherein the value of the adjoint variable is calculated directly from the speed of the train.

13. The method of monitoring the progress of a train on a rail network as claimed in claim 1, wherein a numerical method is used to solve the system of differential equations for the speed profile of the train and for the value of the adjoint variable.

14. A method of monitoring the progress of a train on a rail network and providing information on the progress of the train in real time to an operator of the train, said method comprising:

(i) estimating or determining parameters of the train;

(ii) determining, by an optimal control algorithm employing an adjoint variable, an optimal journey profile for a journey from the train's current location to a target location that results in the train arriving at the target location as close as possible to a desired time and with minimum energy usage; said optimal journey profile including a speed profile for the train, sequence of discrete control modes for the train, and associated switching points between the control modes; the optimal journey profile being determined by solving a system of differential equations for the speed profile of the train and for the value of the adjoint variable and wherein the sequence of discrete control modes is a function of the value of the adjoint variable and is determined as the speed profile is calculated, and wherein drive, hold, coast and brake control modes are each utilizable as one of the control modes in said sequence of discrete control modes;

(iii) monitoring the current state of the train as it progresses to said target location; and (iv) generating said information for the train operator by comparing the current state of the train to a corresponding state on said optimal journey profile and displaying said information for the train operator to assist in keeping the train close to said optimal journey profile.

15. The method of monitoring the progress of a train on a rail network as claimed in claim 14, wherein steps (i) to (iv) are performed as required so that said driving advice automatically adjusts to compensate for any operational disturbances encountered by the train.

16. The method of monitoring the progress of a train on a rail network as claimed in claim 14, wherein said parameters include train mass and mass distribution.

17. The method of monitoring the progress of a train on a rail network as claimed in claim 16, wherein said parameters further include maximum tractive efforts and maximum braking effort as functions of speed.

18. The method of monitoring the progress of a train on a rail network as claimed in claim 16, wherein said parameters further include coefficient(s) of rolling resistance.

19. The method of monitoring the progress of a train on a rail network as claimed in claim 14, wherein said information is generated and displayed by a computer located on the train.

20. The method of monitoring the progress of a train on a rail network as claimed in claim 14, wherein step (iii) involves processing data from a GPS unit and train controls to determine the location and speed of the train.

21. The method of monitoring the progress of a train on a rail network as claimed in claim 14, wherein said optimal journey profile specifies the time, speed and control at each location between the current train location and the next target location on the network.

22. The method of monitoring the progress of a train on a rail network as claimed in claim 14, wherein said optimal journey profile is precomputed.

23. The method of monitoring the progress of a train on a rail network as claimed in claim 14, wherein the discrete control modes for the train include drive, hold, coast and brake modes.

24. The method of monitoring the progress of a train on a rail network as claimed in claim 14, wherein the adjoint variable evolves according to a differential equation along with the position and speed of the train.

25. The method of monitoring the progress of a train on a rail network as claimed in claim 14, wherein the value of the adjoint variable is calculated directly from the speed of the train.

26. The method of monitoring the progress of a train on a rail network as claimed in claim 14, wherein a numerical method is used to solve the system of differential equations for the speed profile of the train and for the value of the adjoint variable.

27. A method of controlling the progress of a train on a rail network, said method comprising:

(i) estimating or determining parameters of the train;

(ii) determining, by an optimal control algorithm employing an adjoint variable, an optimal journey profile for a journey from the train's current location to a target location that results in the train arriving at the target location as close as possible to a desired time and with minimum energy usage; said optimal journey profile including a speed profile for the train, sequence of discrete control modes for the train, and associated switching points between the control modes; the optimal journey profile being determined by solving a system of differential equations for the speed profile of the train and for the value of the adjoint variable and wherein the sequence of discrete control modes is a function of the value of the adjoint variable and is determined as the speed profile is calculated, and wherein drive, hold, coast and brake control modes are each utilizable as one of the control modes in said sequence of discrete control modes;

(iii) monitoring the current state of the train as it progresses to said target location; and (iv) comparing the current state of the train to a corresponding state on the optimal journey profile and then controlling the train to keep the train close to the optimal journey profile.

28. The method of controlling the progress of a train on a rail network as claimed in claim 27, wherein the discrete control modes for the train include drive, hold, coast and brake modes.

29. The method of controlling the progress of a train on a rail network as claimed in claim 27, wherein the adjoint variable evolves according to a differential equation along with the position and speed of the train.

30. The method of controlling the progress of a train on a rail network as claimed in claim 27, wherein the value of the adjoint variable is calculated directly from the speed of the train.

31. The method of controlling the progress of a train on a rail network as claimed in claim 27, wherein a numerical method is used to solve the system of differential equations for the speed profile of the train and for the value of the adjoint variable.

32. The method of controlling the progress of a train on a rail network as claimed in claim 27, wherein steps (i) to (iv) are performed as required so as to automatically adjust to compensate for any operational disturbances encountered by the train.

33. The method of controlling the progress of a train on a rail network as claimed in claim 27, wherein said parameters include train mass and mass distribution.

34. The method of controlling the progress of a train on a rail network as claimed in claim 33, wherein said parameters further include maximum tractive efforts and maximum braking effort as functions of speed.

35. The method of controlling the progress of a train on a rail network as claimed in claim 33, wherein said parameters further include coefficient(s) of rolling resistance.

36. The method of controlling the progress of a train on a rail network as claimed in claim 27, wherein step (iii) involves processing data from a GPS unit and train controls to determine the location and speed of the train.

37. The method of controlling the progress of a train on a rail network as claimed in claim 27, wherein said optimal journey profile specifies the time, speed and control at each location between the current train location and the next target location on the network.

38. The method of controlling the progress of a train on a rail network as claimed in claim 27, wherein said optimal journey profile is precomputed.

* * * * *